US005802788A

United States Patent [19]

Ozawa et al.

[11] Patent Number: 5,802,788

[45] Date of Patent: Sep. 8, 1998

[54] FIXING DEVICE FOR TENSIONING MEMBER FOR PRESTRESSED CONCRETE

[75] Inventors: Nobuyuki Ozawa, Chiba-ken; Masao Kikuchi, Kanagawa-ken; Manabu Sotooka; Junji Hosokawa, both of Kanagawa-ken, all of Japan

[73] Assignee: Kabushiki Kaisha Komatsu Seisakusho Komatsu Plastics Industry Co., Ltd., Japan

[21] Appl. No.: 385,126

[22] Filed: Feb. 7, 1995

[30] Foreign Application Priority Data

Feb. 22, 1994 [JP] Japan ..... 6-023884

[51] Int. Cl.[6] ..... E04C 3/10

[52] U.S. Cl. ..... 52/223.13; 52/565; 52/704; 24/122.6

[58] Field of Search ..... 52/223.13, 565, 52/704; 24/122.6, 115 A, 115 M, 136 R

[56] References Cited

U.S. PATENT DOCUMENTS

| | | | |
|---|---|---|---|
| 2,294,398 | 9/1942 | Ferguson | 52/223.13 X |
| 3,820,832 | 6/1974 | Brandestini et al. | 52/223.13 X |
| 4,362,421 | 12/1982 | Kelly | 52/223.13 X |
| 4,619,088 | 10/1986 | Garcia-Mansilla | 52/223.13 |
| 4,631,889 | 12/1986 | Adam et al. | 52/704 X |
| 4,662,134 | 5/1987 | Illgner | 52/223.13 |
| 4,707,890 | 11/1987 | Jose et al. | 24/122.6 |

FOREIGN PATENT DOCUMENTS

| | | | |
|---|---|---|---|
| 61-161327 | 10/1986 | Japan . | |
| 46452 | 2/1992 | Japan . | |
| 7116520 | 10/1992 | Japan . | |
| 916813 | 1/1963 | United Kingdom | 52/704 |

*Primary Examiner*—Wynn E. Wood
*Assistant Examiner*—Beth A. Aubrey
*Attorney, Agent, or Firm*—Ronald P. Kananen

[57] ABSTRACT

A fixing device for a tensioning member of a prestressed concrete may uniformly act holding force for the tensioning member on the overall peripheral surface of the tensioning member mating with the wedge. The device includes a stationary grip through which the tensioning member extends, a wedge press fitted to the grip with holding the tensioning member for fixing the tensioning member relative to the grip under a given tension, and a buffer member disposed between the tensioning member and the wedge, the buffer member having both elasticity and plasticity.

23 Claims, 6 Drawing Sheets

FIXING DEVICE FOR TENSIONING MEMBER FOR PRESTRESSED CONCRETE

BACKGROUND OF THE INVENTION

1. Field of the Invention

The present invention relates generally to a fixing device for a tensioning member used in prestressed concrete, and more particularly to a fiber reinforced plastic tensioning member used in prestressed concrete.

2. Description of the Related Art

As is well known, a fixing device includes a separate type wedge 2 which has a tapered outer periphery and which grips each end of a tensioning member 1, and a grip 3 which accommodate the wedge 2, as shown in FIGS. 1A and 1B. The wedge 2 grips one end of the tensioning member and is set in the grip 3. Thereafter, tension is applied to the tensioning member 1 by means of a center hole jack or the like. At this time, due to the tensioning force, the wedge 2 is forced into the grip 3 to progressively increase the fixing or clamping force applied to the tensioning member 1.

In the fixing device of this type, the wedge 2 is designed so that the fixing force or wedge force increases at the tip end so as to effectively utilize the wedge force in the manner shown in FIG. 1B. Therefore, the fixing or retaining force maximizes at the smaller diameter end. As a result, a large stress (concentrated stress) is locally applied to the tensioning member at the portion mating with the small diameter end of the wedge 2.

This type of stress concentration is not a substantial problem in the case of the tensioning member made of steel. However, in case of a fiber reinforced plastic (hereinafter referred to as "FRP") tension member, this type of stress concentration creates substantial problems.

A tensile breaking test was performed by fixing a test sample of FRP provided with intersecting grooves as shown in FIG. 2. The specifications of the test sample are as follows:

Test Sample

Resin: Epoxy resin

Reinforcement Fiber: Carbon fiber (Fiber strength 500 kg/mm$^2$)

Vf: 65%

Rod Configuration: FRP rod of 8 mm diameter with intersecting grooves (width 4×depth 0.12×pitch 40 mm)

The results of the test are shown in the following table 1.

TABLE 1

| Test Sample No. | 1 | 2 | 3 | 4 | 5 | 6 | 7 | 8 | 9 | 10 | |
|---|---|---|---|---|---|---|---|---|---|---|---|
| Break Force (ton) | slip | slip | 10.5 | 9.8 | 9.5 | slip | 10.4 | slip | 8.8 | 9.2 | |
| | 11 | 12 | 13 | 14 | 15 | 16 | 17 | 18 | 19 | 20 | Ave. |
| | slip | 7.5 | 8.9 | 9.6 | slip | slip | 9.7 | 8.9 | slip | 9.0 | 9.3 |

The results for twelve samples, which tested without slip, showed the average breakage load was 9.3 ton.

The original breakage tension force of the test sample is greater than or equal to 16 ton. Despite of this fact, breakage was caused at 9.3 tons in average. Therefore, sufficient tension force cannot be applied for the prestressed concrete.

One proposed solution of this problem has been disclosed in Japanese Unexamined Utility Model Publication (Kokai) No. Showa 61-161327. The prior art disclosed in the above-identified publication is illustrated in FIG. 3. As shown, the proposal employs a mesh-form cover body 4 formed of metal wire. The cover body 4 is disposed between the wedge 2 and the tensioning member 1.

In the known construction as illustrated in FIG. 3, a test was performed employing a cover body 4 formed of brass wire of 0.0066 mm diameter and 150 mesh. In this case, the fixing force applied from the wedge 2 to the tensioning member 1 is as illustrated by the solid line in FIG. 4. As will be appreciated from a comparison of the solid line with the broken line which represents the fixing force in the case where the cover body 4 is not employed, stress concentration can be reduced by a certain degree. However, line contact due to the mesh-structure of the cover body concentrically received the fixing force resulted in stress concentration. The following table 2 shows the results of tensile breaking tests performed employing test samples having substantially the same specifications as the former example.

TABLE 2

| Teat Sample No. | 1 | 2 | 3 | 4 | 5 | 6 | 7 | Ave. |
|---|---|---|---|---|---|---|---|---|
| Break Force (ton) | 6.9 | 5.4 | 7.1 | 5.4 | 6.9 | 5.2 | slip | 6.2 |

As seen, the average breakage load was 6.2 tons which is less than that of the former example of FIG. 1.

Similar test was also performed with employing the cover body formed of brass wire having a 0.193 mm diameter and 50 mesh. The result of the test is shown in the following table 3.

TABLE 3

| Teat Sample No. | 1 | 2 | 3 | 4 | 5 | 6 | 7 | Ave. |
|---|---|---|---|---|---|---|---|---|
| Break Force (ton) | 5.4 | 7.2 | 6.3 | 5.6 | 6.4 | 5.8 | 5.8 | 6.1 |

As shown, the average shearing load is 6.1 which is worse than that of the former example.

Japanese Unexamined Utility Model Publication No. Heisei 4-116520 and Japanese Examined Utility Model Publication (Kokoku) No. Heisei 4-6452 respectively disclose second and third examples of fixing bodies.

In the second prior art, it is proposed to provide an elastic layer between the wedge and the tensioning member so that the tensioning member can be gripped softly. This prior art employs a soft material, such as rubber, to form the elastic layer. In this case, the deformation magnitude at small stress levels becomes substantial. Therefore, before sufficient tension can be applied to the tensioning member, the elastic layer is apt to become expanded and loose and to lower the tension.

On the other hand, in case of the foregoing third example of prior art, a buffer member is disposed between the wedge and the tensioning member. For both of the buffer member and the contact surface of the wedge, engaging portions between projections and recesses are formed. Also, a recessed groove is formed on the inner periphery of the buffer member. In such construction, it is required to provide the engaging portion of the projections and recesses on the inner periphery of the wedge and on the outer periphery of the buffer member, and a recessed groove on the inner periphery of the buffer member. This causes substantial increase of the processing cost. In addition, in this third prior art, due to the presence of the recessed groove on the inner periphery of the buffer member and the buffer member being separated in the circumferential direction, a portion of the buffer member may not contact when under tension. Therefore, similarly to the foregoing second prior art, this portion serves as a cause of stress concentration.

As set forth above, in the fixing device for the tensioning member in the prior art, it has been not possible to provide sufficient tension force.

The tensioning member to be employed in the prestressed concrete, it is required to introduce high tension force for providing sufficient tension for the prestressed concrete, in either case of the FRP tensioning member or the metallic tensioning member. Therefore, the required tensile strength of the tensioning member is substantially high for introducing high tension force even in the case where typical steel reinforcement is employed in the prestressed concrete.

In order to obtain sufficient tension force, it becomes necessary to provide a substantially high holding or clamping force for the wedge of the fixing device. This potentially results in an increase in the concentrated stress at the tip end of the wedge to cause breakage of the tensioning member so that the breakage of the tensioning member due to stress concentration may be caused before occurrence of breakage due to excessive tension. Namely, since the breaking force upon introduction of the tensioning force depends on the stress concentration at the tip end of the wedge, it becomes necessary to provide a buffer member for buffering stress concentration.

In particular, in case of the tensioning member formed of the FRP, while the strength in the longitudinal direction (direction of orientation of the fiber) is substantially high, it has much lower strength against local tension force or shearing force associated with stress concentration by the wedge, in comparison with the metallic tensioning member. Therefore, when a FRP tensioning member is employed, it is inherently required to realize a high tension force, a high holding force associated with the high tension force and stress distribution at the fixing portion.

SUMMARY OF THE INVENTION

It is therefore an object of the present invention to provide a fixing device for a tensioning member of a prestressed concrete, in which a holding force of a wedge may uniformly act on the overall peripheral surface of the tensioning member mating with the wedge.

Another object of the invention is to provide a fixing device which will never cause stress concentration at the fixing surface and can add a tensile breakage force substantially close to an original tensile breakage force to an FRP tensioning member.

According to one aspect of the invention, fixing device for a tensioning member for a prestressed concrete comprises:

- a stationary grip through which the tensioning member extends;
- a wedge press fitted to the grip with holding the tensioning member for fixing the tensioning member relative to the grip under a given tension; and
- a buffer member disposed between the tensioning member and the wedge, the buffer member having elasticity and plasticity.

The buffer member may be formed into a tubular configuration. In the alternative, the buffer member may be formed into a plate-like configuration.

At least one of a mating pair of the buffer member and the tensioning member and a mating pair of the buffer member and the wedge may be mechanically coupled for integrity.

The buffer member may be formed of a material having both elasticity and plasticity. Preferably, the buffer member is formed of a material selected among aluminum, aluminum alloy, copper, copper alloy, fiber reinforced plastic, a tempered iron and composite material thereof.

The buffer member may be formed into a configuration selected among a tubular configuration and a plate form configuration to be wrapped around the tensioning member. In such case, it is preferred that the buffer member is formed with at least one slit extending in axial direction for a length at least one half of the axial length of the wedge. The buffer member may be formed with a plurality of slits with a given interval in the circumferential direction. Also, the axial length of the slit may be longer than the axial length of the wedge.

According to another aspect of the invention, a fixing device for a tensioning member for a prestressed concrete comprises:

- a stationary grip through the tensioning member extends;
- a wedge press fitted to the grip with holding the tensioning member for fixing the tensioning member relative to the grip under a given tension, the wedge generating progressively increasing gripping force for gripping the tensioning member according to increasing of penetration magnitude into the grip; and
- a buffer member disposed between the external surface of the tensioning member and the internal surface of the wedge, the buffer member having elasticity and plasticity.

The buffer member may be formed with a slit.

According to a still further aspect, a tensioning structure for a prestressed concrete comprises:

- an elongated tension carrier;
- stationary member having an opening through which the tension carrier extends;
- tension retainer cooperated with the tension carrier and stationary member for fixing the tension carrier relative to the stationary member in a condition where a predetermined magnitude of tension force is applied to the tension carrier;
- stress distributor disposed between the tension carrier and the tension retainer, the stress distributor having a first surface mating with the surface of the tension carrier and having surface configuration complementary with the surface configuration of the tension carrier and a second surface mating with the surface of the tension retainer and having surface configuration complementary with the surface configuration of the tension retainer for distributing retaining force of the tension retainer to substantially entire surface of the tension carrier.

The stress distributor may be made of a material which can be deformed elastically and plastically. Also, the material of the stress distributor may have a shear strength withstanding to a shear stress at the predetermined magnitude of tension force.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

Figure 6:
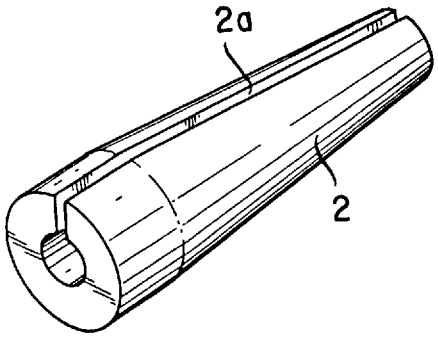
FIG. 6 is a perspective view showing another embodiment of the fixing device according to the invention.
Figure 7:
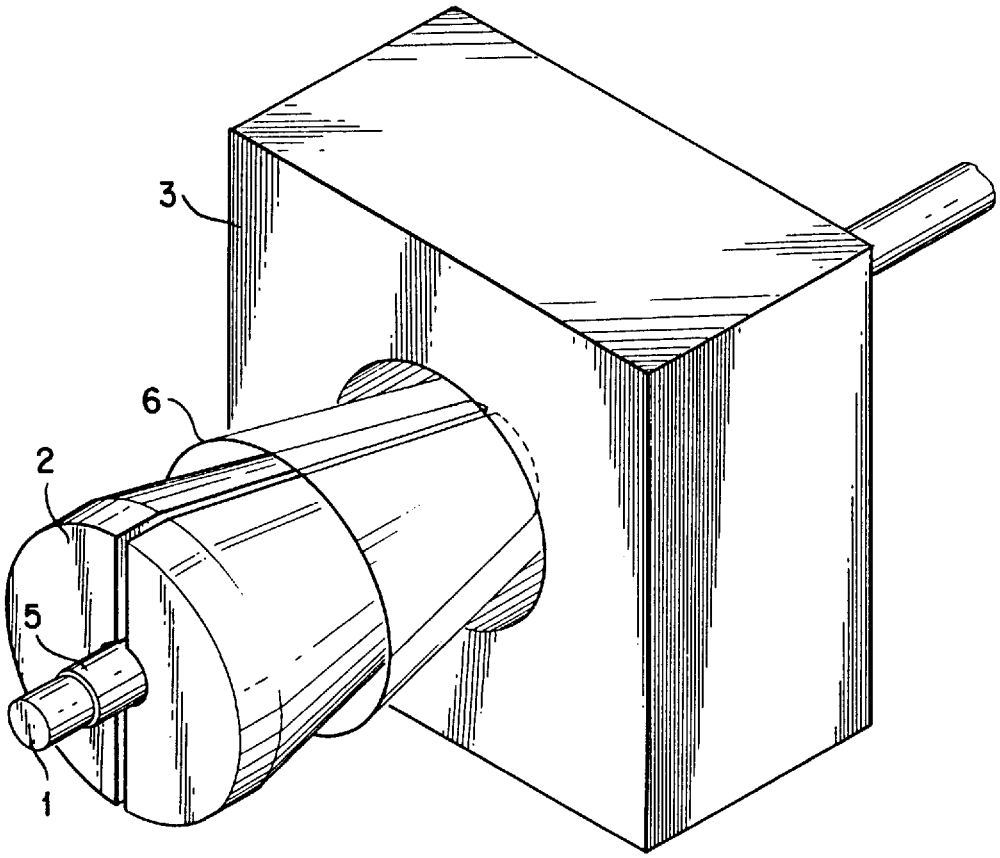
FIG. 7 is an exploded perspective view showing the case wherein the fixing device is assembled with a plastic film disposed between the wedge and a grip.
Figure 8:
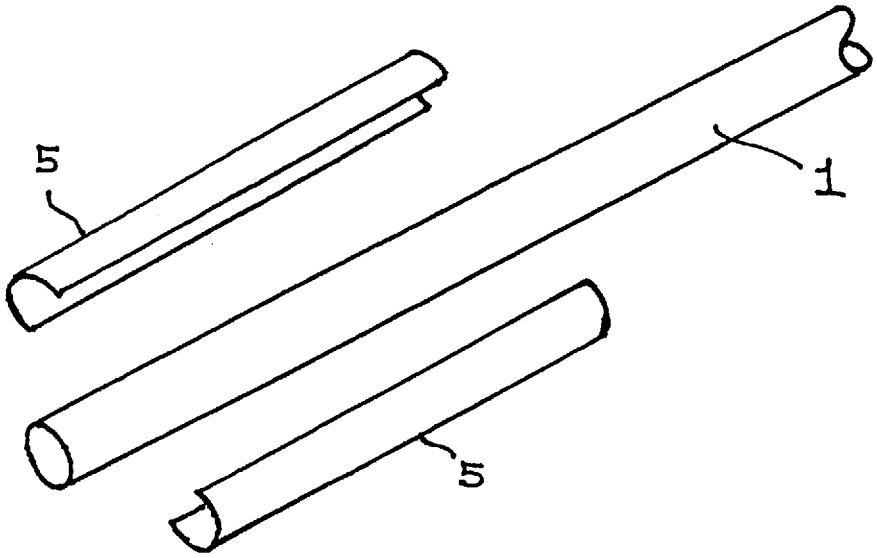
FIG. 8 is a perspective exploded view showing an arrangement wherein a buffer member is formed from plates of material which are wrapped onto the exterior of a tensioning rod member.

The present invention will be discussed in detail hereinafter with reference to FIGS. 5 to 7. In the following disclosure, the reference numerals used in FIGS. 1 to 4 are also used in FIGS. 5 to 7 to represent like elements. Therefore, a detailed discussion for such common elements will be omitted for avoiding redundant discussion and keeping the disclosure simple and to facilitate understanding of the invention. In the following description, numerous specific details are set forth in order to provide a thorough understanding of the present invention. It will be obvious, however, to those skilled in the art that the present invention may be practiced without these specific details. It will also be noted that well-known structures are not shown in detail in order to avoid obscuring the features of the present invention.

A sleeve-like tubular body 5 is formed from a material having both elasticity and plasticity. Such material will be hereinafter referred to as "elastoplastic material" or "elastoplastic body" is disposed between the FRP tensioning member 1 and the separate type wedge 2. In this embodiment, aluminum is employed as the elastoplastic material. The elastoplastic tubular body 5 is fitted between the tensioning member 1 and the wedge 2 tightly and without any gap therebetween.

On the other hand, the FRP tensioning member 1 is formed from a reinforcement fiber, such as inorganic fiber including carbon fiber, glass fiber or the like, aramide fiber, polyethylene fiber or the like, and a matrix resin including a thermosetting resin, such as epoxy resin, unsaturated polyester resin or the like and a thermoplastic resin, a nylon resin, etc. In the illustrated embodiment, the tensioning member is formed of a carbon fiber reinforced epoxy resin composite body.

For performing tensile breaking test, test samples were prepared according to the following specification.

Test Sample

Resin: Epoxy resin

Reinforcement Fiber: Carbon fiber (Fiber strength 500 $kg/mm^2$)

Vf: 65%

Rod Configuration: FRP rod of 8 mm diameter with intersecting grooves (width 4×depth 0.12×pitch 40 mm)

As will be appreciated, the test samples were identical in specification to those used for the tensile breaking test of the conventional devices.

Tensile breaking test was performed in the following manner. As shown in FIG. 5, the test sample is fixed by the fixing means by interpositioning the tubular body 5 under tension. The tubular body 5 used in the test was an aluminum tube having 10 mm of external diameter, 8.05 mm of internal diameter (actually measured value: nominal value in brochure was 8.00 mm). After setting, tension was applied to the test sample by a center hole jack until breakage occured. The load upon breakage was measured by a load cell. As the material of the aluminum tube, a material of #1050 of JIS standard was used.

The result of the tensile breaking test is shown in the following table 4.

TABLE 4

| Test Sample No. | 1 | 2 | 3 | 4 | 5 | 6 | 7 | 8 | 9 | 10 | Ave. |
|---|---|---|---|---|---|---|---|---|---|---|---|
| Brake Force (ton) | 12.9 | 132 | 13.2 | 12.7 | 13.0 | 13.5 | 13.4 | 13.8 | 13.7 | 12.5 | 13.2 |

From the result of test, the average value of the tensile breakage test was found to be 13.2 tons which is much greater than any of the conventional fixing devices disclosed above. Also, since the original tensile breakage force of the FRP tensioning member is approximately 16 tons, it can be said that the tensile breakage force achieved by this embodiment is satisfactorily close to the original tensile breakage force of the FRP tensioning member. Furthermore, fluctuation of the results is much smaller than the prior art to provide stable test results.

In the embodiment of the present invention, the tubular body 5 has its entire inner and outer peripheral surfaces are respectively fitted onto the external periphery of the tensioning member 1 and the internal periphery of the wedge 2. Therefore, when the tubular body 5 is compressed by the wedge 2, the tubular body 5, in turn, exerts compression force onto the entire external periphery of the tensioning member 1.

As a result, the fixing force is unified not only in the circumferential direction but also in the lateral direction. At this time, the distribution of the stress in the axial direction becomes substantially uniform through the entire length of the wedge. Therefore, the problem of the stress concentration can be reduced. Also, the crushed portion of the tubular body penetrates into the mating clearance between the separated fractions of the wedge 2.

It is considered that the illustrated embodiment of the present invention has achieved superior results as shown in the table 4 due to the behavior of the tubular body 5 as set forth above. Also, as set forth above, with this embodiment, the FRP tensioning member may be fixed at a tensile breakage load substantially close to the original tensile strength (16 tons) of the FRP tensioning member.

Results of tensile breaking tests in the terms differentiated from those in the former tensile breaking tests will be briefly discussed. In the additional tests, the manner of fixing the tensioning member, the test sample and testing device were the same as the former tests. The only difference was in the depth of the grooves formed in the tensioning member 1. The results of tests are shown in the following tables 5, 6 and 7. Table 5 shows the case where the depth of the groove is zero, table 6 shows the case where the depth of the groove is 0.5 mm, and table 7 shows the case where the depth of the groove is 0.7 mm. It should be noted that the average value of the result for the table 7 is the average obtained with respect to seven tests wherein slip did not occur.

TABLE 5

| Test Sample No. | 1 | 2 | 3 | 4 | 5 | 6 | 7 | 8 | 9 | 10 | Ave. |
|---|---|---|---|---|---|---|---|---|---|---|---|
| Brake Force (ton) | 12.8 | 13.0 | 13.5 | 12.5 | 13.3 | 13.3 | 13.8 | 12.9 | 12.9 | 13.1 | 13.1 |

TABLE 6

| Test Sample No. | 1 | 2 | 3 | 4 | 5 | 6 | 7 | 8 | 9 | 10 | Ave. |
|---|---|---|---|---|---|---|---|---|---|---|---|
| Brake Force (ton) | 12.6 | 12.0 | 12.8 | 12.2 | 11.9 | 12.9 | 13.0 | 13.0 | 12.2 | 12.3 | 12.5 |

TABLE 7

| Test Sample No. | 1 | 2 | 3 | 4 | 5 | 6 | 7 | 8 | 9 | 10 | Ave. |
|---|---|---|---|---|---|---|---|---|---|---|---|
| Brake Force (ton) | slip | 12.0 | 11.3 | 10.0 | 12.3 | slip | 11.0 | slip | 10.3 | 11.8 | 11.2 |

As will be clear from the above, the preferred depth of the groove on the tensioning member 1 is less than 0.5 mm.

It should be noted that while the foregoing embodiment employs a tubular body 5 as the buffer, the configuration of the buffer member is not limited to a tubular configuration and can be of any suitable configuration. For instance, the buffer member may be in the form of the tube with a slit extending in the entire axial length or in a form of a plate or sheet which is wound or wrapped around the tensioning member. In short, any configuration establishing surface-to-surface contact between the buffer member with tensioning member and the wedge may be applicable.

In the preferred construction, the tubular body 5 is formed with at least one axially extending slit. The length of the slit is preferably longer than or equal to half of the length of the wedge, and more preferably longer than the entire length of the wedge 2. In such case, the tubular body 5 is positioned so that the slit is positioned at least at the position mating with the small diameter end of the wedge. The preferred number of slits is four in that the slits may be arranged around the tensioning member at constant intervals. Then, upon deformation of the tubular body 5, deformation may be caused uniformly through the entire circumference of the tensioning member 1 to maintain firm contact with the tensioning member 1 and the wedge 2. In this connection, when the tubular body 5 is employed, it is preferred to form four slits at approximately 90° intervals. On the other hand, in the case where the buffer member is formed of plate members, and two plate members are arranged in opposition on the tensioning member, one slit is formed for each individual plate member. In addition, when a reduction of the weight of the buffer member is desired, it may be possible to form material reduction holes through the tubular body or the plate member to the extent that no stress concentration is caused.

As set forth above, the buffer member, such as the tubular body or the plate member, is formed with the elastoplastic body. As the elastoplastic body, a material having both elasticity and plasticity is selected so as to permit elastic deformation in response to application of stress without causing brittle breakage and further permit plastic deformation to conform with the surface configurations of the tensioning member 1 and/or the wedge 2.

As examples of the material having both of the elasticity and plasticity, various metals, rubber, resin and so forth may be considered. In case of the rubber as the elastic body, it may be possible to prevent slippage and stress concentration since the rubber may establish uniform contact with the tensioning member. However, since the rubber has a large elastic deformation magnitude and a low critical point with respect to stress, the deformation magnitude of the rubber will be excessive and cause loosing of the tensioning member 1. Alternatively, the rubber may break even at a low tension force due to the low critical point. Therefore, rubber may not be considered as suitable material for forming the buffer body.

On the other hand, material which undergoes only plastic deformation without causing elastic or resilient deformation, is also available. Such material includes lead, solder and so forth. However, when such a material is employed, a slight deformation due to the exertion of excessive force or thermal expansion, etc., is apt to cause corresponding plastic deformation of the material. Such plastic deformation possibly becomes a cause of slippage. Therefore, the material which only features plastic deformation, is apt not to be suitable.

In case of plastic, since plastics generally have a low critical point, they are not suitable for the reason set out with respect to rubber. However, in the case of fiber reinforced composite material, a reasonable stress buffer effect may be expected. For instance, a tubular body formed of polyacetal resin (available from Polyplastic Co.) containing 10% of carbon fiber and having a 1 mm of wall thickness, exhibited comparable result to that shown in the foregoing table 4.

From the above, as the buffer material, in addition to aluminum, aluminum alloy, copper, copper alloy, fiber reinforced plastic may be suitable. In addition, tempered iron may also be applicable as the buffer material.

Also, composite material, such as a laminate of the foregoing metal and plastic, or three layer structure of metal-plastic-metal may be applicable for forming the buffer member. For instance, aluminum-polyethylene-aluminum laminate body (having respective thickness of 0.5-0.05-0.5 mm) may be employed for forming the tubular body set forth above.

Also, the configuration of the wedge 2 is not specified to the illustrated construction. Namely, while the illustrated embodiment employs a two piece construction of the wedge, the wedge may be constructed in a three piece construction or in a one piece construction with an axially extending slit 2*a*.

It should be noted that while the wedge 2 may be formed of a steel, it is preferred to form the wedge with aluminum or aluminum alloy for capability of appropriate plastic deformation. Particularly, in case of large size fixing device, the wedge of the light metal, such as aluminum or so forth, is preferred in view of workability.

Upon setting of the tensioning member 1 to the fixing device, it may be possible to mechanically couple the buffer member and the tensioning member 1, buffer member and the wedge or all of the tensioning member 1, the buffer member and the wedge, by way of bonding, clamping or screw fastening and so forth, in advance.

Furthermore, while the foregoing discussion is given where the tensioning member has a circular cross-section, the present invention is equally applicable for the tensioning members having cross-sectional configurations other than circular. For instance, the present invention may be applicable for the case where the tensioning member has a quadrangular configuration (such as plate form). It should be naturally understood that, in such case, the wedge should have the complementary configuration to the tensioning member.

In practice, the tensioning member 1 is provided a strength higher than or equal to 100 kg/mm$^2$. In case of the tensioning member with the circular cross-section, the diameter may be within a range of approximately 1 to 25 mm.

Next, consideration will be given for the mechanism of fixing of the tensioning member 1 by the wedge.

Figure 1A:
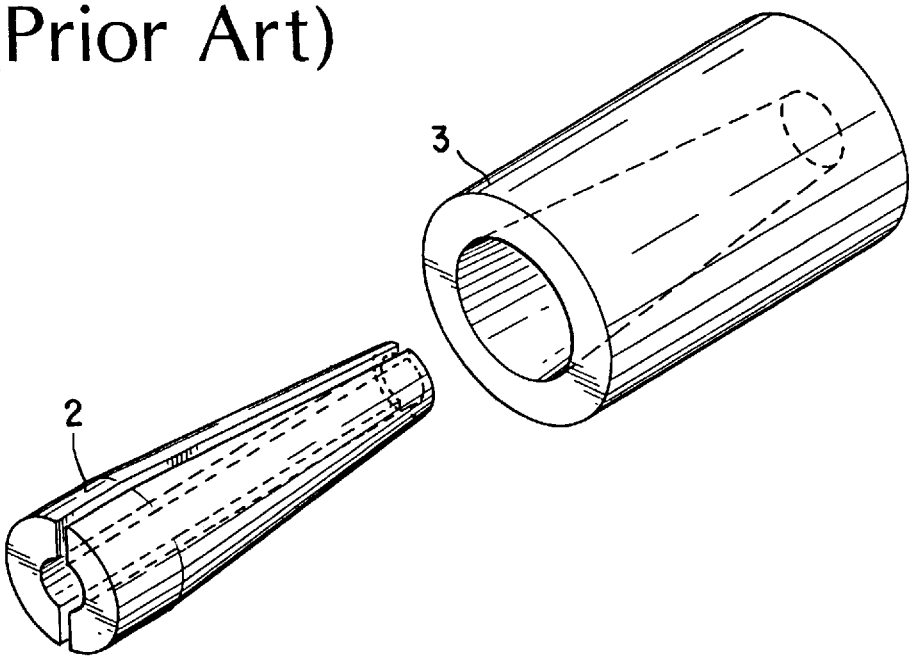
FIG. 1A (Prior Art)
FIGS. 1A and 1B are respectively an exploded perspective view and a section showing features of the conventional tensioning member.
Figure 1B:
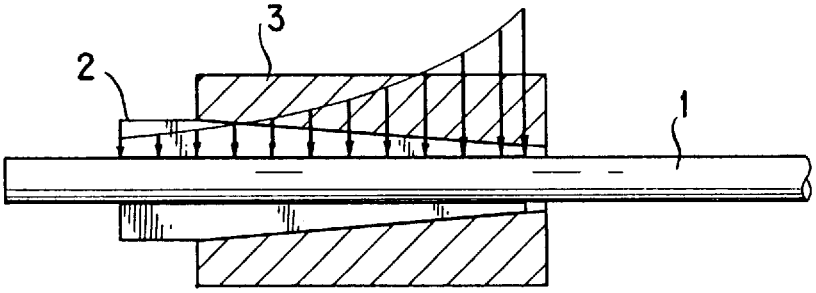
FIG. 1B (Prior Art)
Figure 2:
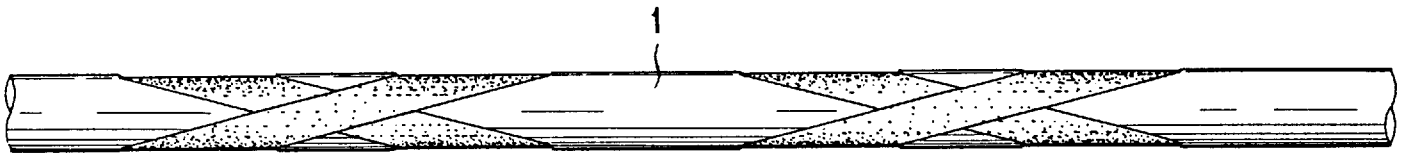
FIG. 2 (Prior Art)
FIG. 2 is a side elevation of the tension device used in the conventional fixing device.
Figure 3:
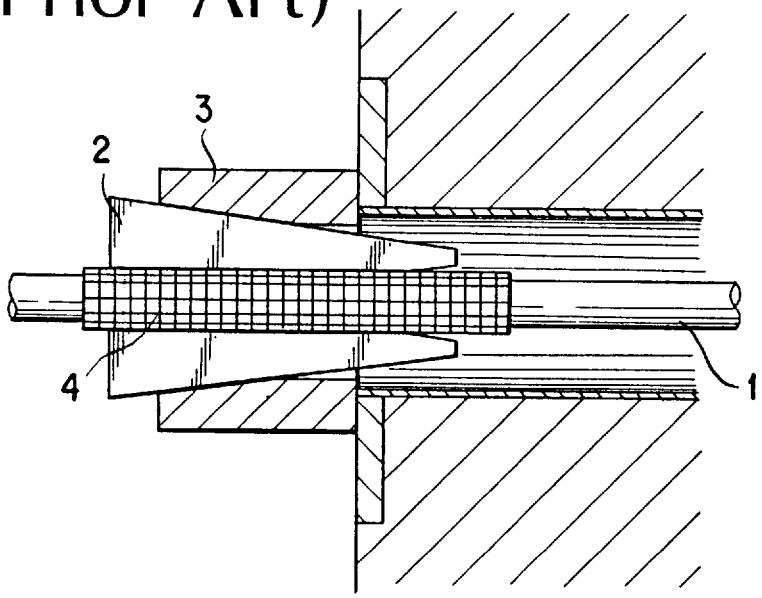
FIG. 3 (Prior Art)
FIG. 3 is a section showing the features of another conventional fixing device.
Figure 4:
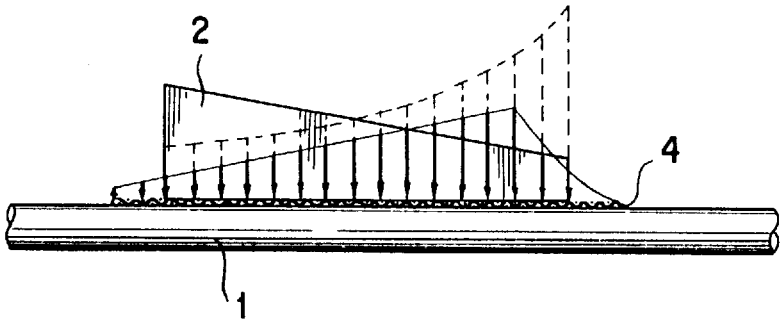
FIG. 4 (Prior Art)
FIG. 4 is an illustration showing the stress distribution produced by the conventional fixing device shown in FIG. 3.
Figure 5:
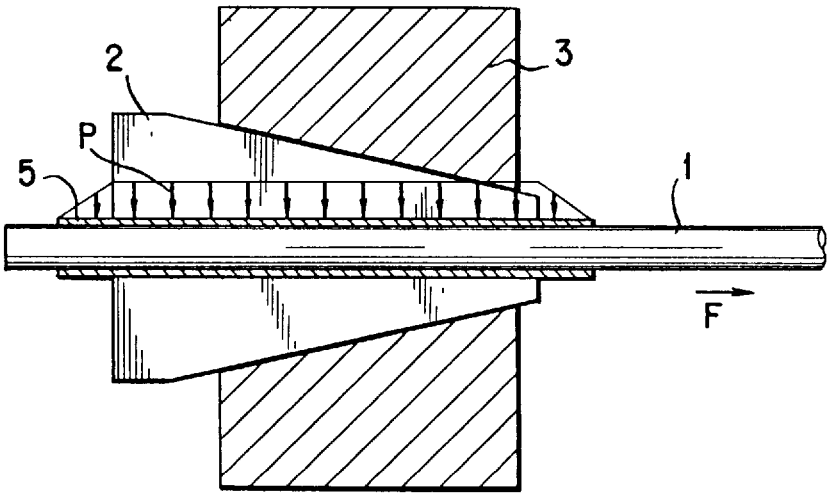
FIG. 5 is a section showing features of the preferred embodiment of the fixing portion according to the present invention.

As shown in FIG. 5, with increasing tension force F, the wedge 2 penetrates into the grip 3 to cause wedge effect to increase the depression force P applied for the tensioning member.

However, if a large tension force is applied to the tensioning member having quite large tensile strength (high strength and large diameter), the penetration magnitude of the wedge into the grip 3 is progressively increased. Associated with this, the depression force P may grow, become excessively large and cause breakage of the tensioning member 1 despite of the fact that stress concentration is prevented by disposing the buffer member between the tensioning member 1 and the wedge.

In order to eliminate such phenomenon, it becomes necessary to employ a material having high work-hardening performance as the buffer member.

Upon fixing the tensioning member 1 by engaging the tensioning member to the wedge 2 via the buffer member and engaging the wedge to the grip, initial slip of the tensioning member 1 may be prevented by pressing the wedge 2 into the grip 3 to cause initial deformation of the buffer member in advance of application of the tension force.

For this purpose, it is the simplest way to hammer the wedge 2 into the grip 3. However, due to frictional resistance between the wedge 2 and grip 3, substantial impact may be required. At this time, it is possible to damage the tensioning member 1. Therefore, it is preferred to dispose an anti-friction material between the wedge and the grip.

As the anti-friction material, a lubricant oil; plastic film and so forth may be used. FIG. 7 shows an example employing the plastic film as the anti-friction material. Namely, when press fitting the wedge 2 into the grip 3, a vinyl film 6 is disposed therebetween. At this time, in view of workability, the vinyl film 6 is preliminarily formed into a bag form to be set with the wedge.

As set forth above, according to the present invention, by disposing the elastoplastic buffer member between the tensioning member 1 and the wedge 2, the buffer member may cause deformation upon press fitting the wedge into the grip for fixing the tensioning member. As a result of the deformation, the buffer member is formed to have the external surface configuration complementary with the internal surface configuration of the wedge and the internal surface configuration complementary with the external surface configuration of the tensioning member. Thus, the buffer member may be tightly fitted with both of the tightening member and the wedge. Under these conditions, the wedge is penetrated into the grip to cause further deformation of the buffer member.

Therefore, by tensioning operation of the tensioning member, the buffer member is caused deformation and completely fixed to the tensioning member. This results in an anchoring effect to prevent slippage between the tightening member and the buffer member. At this time, since complete surface-to-surface contact is established between the buffer member and the tightening member including the groove in the tensioning member, stress can be distributed over the entire mating surface between the tightening member and the buffer member to successfully avoid local stress concentration.

At the same time, since the part of the material of the buffer member may penetrate into the slits formed in the wedge during deformation, firm fitting can be established between the wedge and the buffer member to successfully prevent slippage therebetween.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

We claim:

1. A tensioning structure for a prestressed concrete, comprising:

an elongated tension carrier;

a stationary member having an opening;

a tension retainer cooperated with said tension carrier and said stationary member for fixing said tension carrier relative to said stationary member in a condition where a predetermined magnitude of tension force is applied to said tension carrier, said tension retainer having a single axially extending slit; and a sleeve form stress distributor disposed between said tension carrier and said tension retainer, said stress distributor having a first inner surface mating with an outer surface of said tension carrier and having an inner surface configuration complementary with an outer surface configuration of said tension carrier and a second outer surface mating with an inner surface of said tension retainer and having an outer surface configuration complementary with an inner surface configuration of said tension retainer for distributing a retaining force of said tension retainer to substantially an entire outer circumferential surface of a mating portion of said tension carrier for uniformly distributing a holding force exerted from said stress distributor uniformly over an entire outer circumference of the mating portion of said tension carrier.

2. The tensioning structure as set forth in claim 1, wherein said stress distributor is made of a material which can be deformed elastically and plastically.

3. The tensioning structure as set forth in claim 2, wherein the material of said stress distributor has a shear strength withstanding to a shear stress at said predetermined magnitude of tension force.

4. A tensioning structure comprising:

a stationary grip having an opening extending therethrough;

a wedge having an opening extending therethrough and a length, the wedge being disposed and press fitted within the opening in the stationary grip;

a tensioning member extending within the opening in the wedge, the tensioning member having an outer circumferential surface and a portion adjacent the length of the wedge; and a buffer member disposed within the opening in the wedge and extending between the tensioning member and the wedge, the buffer member having elasticity and plasticity and having an inner circumferential surface in total contact with the outer circumferential surface of the tensioning member at least along the portion of the tensioning member adjacent the length of the wedge.

5. The tensioning structure as set forth in claim 4, wherein said buffer member has a tubular configuration.

6. The tensioning structure as set forth in claim 4, wherein said buffer member is formed from a plate which is wound onto said tensioning member.

7. The tensioning structure as set forth in claim 4, wherein at least one of a mating pair of said buffer member and said tensioning member and a mating pair of said buffer member and said wedge are mechanically coupled for integrity.

8. The tensioning structure as set forth in claim 4, wherein said buffer member is formed of a material which can be deformed elastically and plastically.

9. The tensioning structure as set forth in claim 8, wherein said buffer member is formed of a material selected from the group consisting of aluminum, aluminum alloy, copper, copper alloy, fiber reinforced plastic, a tempered iron and composite material thereof.

10. The tensioning structure as set forth in claim 4, wherein said buffer member is formed into one of a tubular configuration and a plate which is wrapped around said tensioning member.

11. The tensioning structure as set forth in claim 4, wherein said buffer member is formed with at least one slit extending in an axial direction of the buffer member for a length at least one half of the axial length of said wedge.

12. The tensioning structure as set forth in claim 11, wherein said buffer member is formed with a plurality of slits with a given interval in the circumferential direction.

13. The tensioning structure as set forth in claim 11, wherein an axial length of said slit is longer than an axial length of said wedge.

14. The tensioning structure as set forth in claim 11, wherein an axial length of said at least one slit formed in the buffer member is longer than an axial length of said wedge.

15. The tensioning structure as set forth in claim 4, wherein said wedge has an axially extending slit and generates progressively increasing gripping force for gripping said tensioning member according to increasing of penetration magnitude into said grip, and said buffer member distributes a holding force exerted from said wedge uniformly over an entire circumference of a mating portion of said tensioning member.

16. The tensioning structure as set forth in claim 15, wherein said buffer member is formed with a slit.

17. The tensioning structure as set forth in claim 15, wherein said wedge is a single piece member and wherein said slit is the only slit formed in said single piece member.

18. The tensioning structure as set forth in claim 4, wherein said buffer member comprises a buffer means for uniformly distributing a force exerted by said wedge uniformly over the entire surface of said tensioning member disposed within said wedge, said buffer means having a surface which engages the tensioning member, which is continuous and uninterrupted and which is such as to be in total engagement with an outer surface of the tensioning member, the elasticity and plasticity of said buffer means being such that a portion of said buffer means is forced into said single axially extending slit by the uniformly applied force.

19. The tensioning structure as set forth in claim 18, wherein said buffer means is formed of a material selected from the group consisting of aluminum, aluminum alloy, copper, copper alloy, fibre reinforced plastic, and tempered iron.

20. The tensioning structure as set forth in claim 18, wherein said buffer means is formed of a a metal-plastic-metal laminate, and wherein the metal is selected from the group consisting of aluminum, aluminum alloy, copper, copper alloy, and tempered iron.

21. The tensioning structure as set forth in claim 20, wherein said plastic is polyethylene.

22. The tensioning structure as set forth in claim 4, wherein said wedge is a single piece member having an axially extending slit, and said slit is the only slit formed in said single piece member.

23. A fixing device for fixing a tensioning member, comprising:

a stationary grip having an opening extending therethrough;

a wedge having an opening extending therethrough, the wedge being disposed and press fitted within the opening in the stationary grip; and a buffer member disposed within the opening in the wedge, the buffer member adapted to be disposed between the tensioning member and the wedge, the buffer member having elasticity and plasticity and having an inner circumferential surface which is continuous and uninterrupted over a length of said buffer member, said inner circumferential surface defining a continuous and uninterrupted shape for distributing a holding force exerted from said wedge uniformly over an entire circumference of a mating portion of a tensioning member.

* * * * *